US007528339B2

(12) United States Patent
Hanson et al.

(10) Patent No.: US 7,528,339 B2
(45) Date of Patent: May 5, 2009

(54) SEQUENCING SYSTEM AND METHOD OF USE

(75) Inventors: Bruce H. Hanson, Endicott, NY (US); Michael Wisniewski, Owego, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 1012 days.

(21) Appl. No.: 10/630,940

(22) Filed: Jul. 31, 2003

(65) Prior Publication Data

US 2005/0038555 A1 Feb. 17, 2005

(51) Int. Cl.
*B07C 5/00* (2006.01)

(52) U.S. Cl. ..... 209/584; 209/900

(58) Field of Classification Search ..... 209/584, 209/900; 700/223–228
See application file for complete search history.

(56) References Cited

U.S. PATENT DOCUMENTS

| | | | | |
|---|---|---|---|---|
| 3,184,061 | A | 5/1965 | Levy | |
| 3,420,368 | A | 1/1969 | Rosenbert et al. | |
| 3,452,509 | A | 7/1969 | Hauer | |
| 3,520,404 | A | 7/1970 | Pine | |
| 3,596,782 | A | 8/1971 | Morris, Sr. | |
| 3,774,758 | A | 11/1973 | Sternberg | |
| 3,815,083 | A | 6/1974 | Dirks et al. | |
| 3,884,370 | A * | 5/1975 | Bradshaw et al. | 198/350 |
| 4,014,784 | A | 3/1977 | Dunlap | |
| 4,117,975 | A | 10/1978 | Gunn | |
| 4,171,746 | A | 10/1979 | Talyzin et al. | |
| 4,172,525 | A | 10/1979 | Hams et al. | |

(Continued)

FOREIGN PATENT DOCUMENTS

DE 1 160 225 12/1963

(Continued)

OTHER PUBLICATIONS van Mechelen, G, "Automatic Indexing Machine for Mail-Handling Systems", Electrical Communication, vol. 44, No. 1, pp. 72-76, 1969.

(Continued)

*Primary Examiner*—Patrick H Mackey
*Assistant Examiner*—Mark Hageman
(74) *Attorney, Agent, or Firm*—Greenblum & Bernstein, P.L.C.

(57) ABSTRACT

A system and method that sequences product to increase machine throughput and capacity. The system includes a plurality of input feeding devices each randomly receiving product received from a stream of product and a plurality of output groups each having output bins. A control has a mode which constrains the input feeding devices to (i) feeding non-rejected product from the stream of product to assigned output groups of the plurality of output groups associated with a corresponding one of the plurality of input feeding devices based on a code associated with each of the product, and (ii) feeding rejected product to at least one output bin in a single group of the plurality of output groups such that each of the plurality of input feeders has access to the at least one output bin. The method includes feeding the non-rejected and rejected product to appropriate output bins such that the rejected product is provided to an output bin which is accessible by any of the input feeding devices.

23 Claims, 4 Drawing Sheets

U.S. PATENT DOCUMENTS

| | | | | |
|---|---|---|---|---|
| 4,247,008 | A | | 1/1981 | Dobbs |
| 4,295,206 | A | | 10/1981 | Cain et al. |
| 4,358,016 | A | | 11/1982 | Richardson et al. |
| 4,503,977 | A | | 3/1985 | Kohno et al. |
| 4,507,739 | A | | 3/1985 | Haruki et al. |
| 4,520,447 | A | | 5/1985 | Nara |
| 4,566,595 | A | | 1/1986 | Fustier |
| 4,601,396 | A | | 7/1986 | Pavie |
| 4,611,280 | A | | 9/1986 | Linderman |
| 4,611,310 | A | | 9/1986 | Durbin |
| 4,632,252 | A | | 12/1986 | Haruki et al. |
| 4,641,753 | A | | 2/1987 | Tamada |
| 4,796,196 | A | | 1/1989 | Durst, Jr. et al. |
| 4,809,187 | A | | 2/1989 | Adams |
| 4,868,570 | A | | 9/1989 | Davis |
| 4,963,251 | A | | 10/1990 | Böhm et al. |
| 4,998,626 | A | | 3/1991 | Ota |
| 5,005,124 | A | | 4/1991 | Connell et al. |
| 5,009,321 | A | * | 4/1991 | Keough ..... 209/3.1 |
| 5,042,667 | A | | 8/1991 | Keough |
| 5,058,750 | A | | 10/1991 | Graese |
| 5,097,959 | A | | 3/1992 | Tilles et al. |
| 5,097,960 | A | | 3/1992 | Tilles et al. |
| 5,119,954 | A | | 6/1992 | Svyatsky et al. |
| 5,174,454 | A | | 12/1992 | Parkander |
| 5,287,271 | A | * | 2/1994 | Rosenbaum ..... 705/8 |
| 5,287,976 | A | * | 2/1994 | Mayer et al. ..... 209/547 |
| 5,346,072 | A | | 9/1994 | Dian et al. |
| 5,353,938 | A | | 10/1994 | LaGrange et al. |
| 5,363,971 | A | | 11/1994 | Weeks et al. |
| 5,385,243 | A | | 1/1995 | Jackson et al. |
| 5,419,457 | A | | 5/1995 | Ross et al. |
| 5,421,464 | A | | 6/1995 | Gillmann et al. |
| 5,687,850 | A | | 11/1997 | Speckhart et al. |
| 5,727,200 | A | | 3/1998 | Narita et al. |
| 5,730,299 | A | | 3/1998 | Helsley |
| 5,810,174 | A | | 9/1998 | Hamada et al. |
| 5,852,826 | A | | 12/1998 | Graunke et al. |
| 5,857,186 | A | | 1/1999 | Narita et al. |
| 5,893,464 | A | | 4/1999 | Kiani et al. |
| 5,901,855 | A | | 5/1999 | Uno et al. |
| 5,924,576 | A | | 7/1999 | Steenge |
| 5,967,503 | A | * | 10/1999 | Newsome ..... 270/52.04 |
| 5,990,438 | A | | 11/1999 | Yamashita et al. |
| 6,054,666 | A | | 4/2000 | Yamashita et al. |
| 6,064,023 | A | | 5/2000 | Lile et al. |
| 6,075,873 | A | | 6/2000 | Kondou et al. |
| 6,082,521 | A | | 7/2000 | Maier et al. |
| 6,107,587 | A | | 8/2000 | Itoh et al. |
| 6,107,588 | A | * | 8/2000 | De Leo et al. ..... 209/584 |
| 6,107,589 | A | | 8/2000 | Yamashita et al. |
| 6,126,017 | A | | 10/2000 | Hours |
| 6,166,346 | A | | 12/2000 | Yamashita et al. |
| 6,219,994 | B1 | | 4/2001 | Taniguchi |
| 6,227,378 | B1 | | 5/2001 | Jones et al. |
| 6,239,397 | B1 | | 5/2001 | Rosenbaum et al. |
| 6,274,836 | B1 | * | 8/2001 | Walach ..... 209/584 |
| 6,276,509 | B1 | | 8/2001 | Schuster et al. |
| 6,279,750 | B1 | | 8/2001 | Lohmann |
| 6,311,846 | B1 | | 11/2001 | Hayduchok et al. |
| 6,316,741 | B1 | | 11/2001 | Fitzgibbons et al. |
| 6,337,451 | B1 | | 1/2002 | De Leo |
| 6,501,041 | B1 | | 12/2002 | Burns et al. |
| 6,522,943 | B2 | * | 2/2003 | Dierauer ..... 700/223 |
| 6,703,574 | B1 | | 3/2004 | Kecher et al. |
| 6,881,916 | B2 | * | 4/2005 | McLaughlin et al. ..... 209/584 |
| 2002/0104782 | A1 | * | 8/2002 | DeWitt et al. ..... 209/3.3 |

FOREIGN PATENT DOCUMENTS

| | | | |
|---|---|---|---|
| DE | 1160225 | | 12/1963 |
| DE | 1 574 092 | | 3/1971 |
| DE | 1574092 | | 3/1971 |
| DE | 1 574 564 | | 11/1971 |
| DE | 1574564 | | 11/1971 |
| DE | 24 43 418 | | 3/1976 |
| DE | 2443418 | | 3/1976 |
| DE | 27 42 802 | | 4/1979 |
| DE | 2742802 | | 4/1979 |
| DE | 27 54 469 | | 7/1979 |
| DE | 2754469 | | 7/1979 |
| DE | 29 08 500 | | 9/1980 |
| DE | 2908500 | | 9/1980 |
| DE | 43 02 231 | C2 | 8/1995 |
| DE | 4302231 | | 8/1995 |
| DE | 1 9647973 | | 9/1997 |
| DE | 196 47 973 | C1 | 9/1997 |
| DE | 1 9709232 | | 11/1997 |
| DE | 197 03 232 | A1 | 11/1997 |
| DE | 197 09 232 | A1 | 11/1997 |
| DE | 1 9625007 | | 1/1998 |
| DE | 1 9629125 | | 1/1998 |
| DE | 196 25 007 | A1 | 1/1998 |
| DE | 196 29 125 | A1 | 1/1998 |
| EP | 0 428 416 | A1 | 5/1991 |
| EP | 0 428 416 | B1 | 5/1991 |
| EP | 0428416 | | 5/1991 |
| EP | 0 533 536 | B1 | 3/1996 |
| EP | 0533536 | | 3/1996 |
| EP | 0 761 322 | A1 | 3/1997 |
| EP | 0761322 | | 3/1997 |
| EP | 0 862 953 | A1 | 9/1998 |
| EP | 0 916 412 | B1 | 3/2003 |
| EP | 0916412 | | 3/2003 |
| GB | 0944747 | | 12/1963 |
| WO | WO 93/14008 | | 7/1993 |

OTHER PUBLICATIONS

McPartland, BJ., "Centralizing the Control of Postal Service Conveyor Systems", Electrical Construction and Maintenance, vol. 86, No. 6, pp. 49-56, Jun. 1987.

* cited by examiner

SEQUENCING SYSTEM AND METHOD OF USE

BACKGROUND OF THE INVENTION

1. Field of the Invention

The invention generally relates to a sequencing system and method of use and, more particularly, to a sequencing system using multiple induction points to sequence products and a method of use.

2. Background Description

The sorting of mail is a very complex, time consuming task. In general, the sorting of mail is processed though many stages, including processes which sort or sequence the mail in delivery order sequence. These processes can either be manual or automated, depending on the mail sorting facility, the type of mail to be sorted such as packages, flats and letters and the like. A host of other factors may also contribute to the automation of the mail sorting, from budgetary concerns to modernization initiatives to access to appropriate technologies to a host of other factors.

In general, however, most modern mail handling facilities have taken major steps toward automation by the implementation of a number of technologies. These technologies include, amongst others, letter sorters, parcel sorters, advanced tray conveyors, flat sorters and the like. As a result of these developments, postal facilities and other mail handling facilities have become quite automated over the years, considerably reducing overhead costs. Without these automated systems, it would be virtually impossible for the postal system such as the United States Postal Service (USPS) to efficiently deliver mail pieces in a time sensitive and cost efficient manner. But, further developments must still be made in order to ever increase throughput and capacity of these automated systems.

In known automated systems, the mail pieces are provided in random order to the postal service or other mail handling facility. At these mail facilities, the mail pieces are then sequenced in delivery point order by many different, complex processes and systems. In one type of automated system, for example, a multiple pass process is utilized with a single induction point, i.e., input feeding device. In these systems, bar code readers (e.g., optical character recognition (OCR)) and transport systems are used to read and sort the mail pieces in a delivery point sequence. In general, the mail pieces are fed through the single induction point for a first pass sorting. Thereafter, the mail pieces are again fed through the same single induction point to sort the mail pieces in a delivery point sequence. But, using this type of system involves considerable machine overhead and accuracy.

By use of a specific example, a carousel-type system with a single induction point is typically able to handle approximately 8,000 pieces of mail per hour, and uses different holding trays or bins for different sets of delivery points. In using this type of system, utilizing a two pass algorithm, directions are assigned to a set of delivery points, all of which are assigned to output bins or holding trays of the carousel. Taking four directions with 16 delivery points, for example, a first portion of the algorithm may assign the following directions to each delivery point:

| Directions | Delivery Points | | | |
|---|---|---|---|---|
| Direction #1 | 1 | 5 | 9 | 13 |
| Direction #2 | 2 | 6 | 10 | 14 |

-continued

| Directions | Delivery Points | | | |
|---|---|---|---|---|
| Direction #3 | 3 | 7 | 11 | 15 |
| Direction #4 | 4 | 8 | 12 | 16 |

However, these sets of delivery points are not in any particular order. Thus, in such an arrangement, the holding trays are removed from the system, and the mail is then fed back through the single induction point. In doing so, it is now possible to reassign the directions in the following manner, for example,

| Directions | Delivery Points | | | |
|---|---|---|---|---|
| Direction #1 | 1 | 2 | 3 | 4 |
| Direction #2 | 5 | 6 | 7 | 8 |
| Direction #3 | 9 | 10 | 11 | 12 |
| Direction #4 | 13 | 14 | 15 | 16 |

Now, each direction is provided in a sequenced set of delivery points. That is, direction 1 has delivery points for 1, 2, 3 and 4. Direction 2 has delivery points for 5, 6, 7, and 8. Direction 3 has delivery points for 9, 10, 11 and 12. Lastly, direction 4 has delivery points for 13, 14, 15 and 16.

Although this type of system is an improvement over manual sorting and sequencing, throughput and capacity of the machine is limited by the single induction point, e.g., input feeding device. Additionally, capacity may be considerably decreased due to misread mail pieces, overcapacity of the system and other known problems.

To increase capacity, other systems are known to use two inductions points. But, in these systems, complications arise due to system constraints such as, for example, machine error, i.e., reading errors, rigidly assigned output grouping schemes and the like, all of which may contribute to a reduced capacity of such system. In the situation of rejected mail pieces, for example, reject output bins are provided in each output group to ensure proper sequencing of the "non-rejected" mail pieces. This system constraint reduces the capacity of the system by an exponential factor. In a two induction point system, using five output bins per grouping, for example, the capacity of the system is reduced by 18 processing points (i.e., (5 original bins$^2$+5 original bins$^2$)−(4 used bins$^2$4 used bins$^2$)). Of course, the more output groups, the larger the reduction in capacity.

Additionally, in such systems, due to the manner in which output bins are assigned in the first and second pass sorting, sorting complications, both manually and automatically, are encountered during the induction phase between the first pass sort to the second pass sort. This has a tendency to not only complicate the sort process, but also considerably decrease (slow down) the throughput of the system.

The invention is directed to overcoming one or more of the problems as set forth above.

SUMMARY OF THE INVENTION

In a first aspect of the invention, a system for sequencing products includes a plurality of input feeding devices each randomly receiving product received from a stream of product. A plurality of output groups each having output bins is further provided. A control system has a mode which constrains the input, feeding devices to (i) feeding non-rejected product from the stream of product to assigned output groups of the plurality of output groups associated with a corresponding one of the plurality of input feeding devices based on a code associated with each of the product, and (ii) feeding rejected product to at least one output bin in a single group of the plurality of output groups such that any of the plurality of input feeders has access to, the at least one output bin.

In another aspect of the invention, a method is provided for sequencing product. The method includes the steps of providing a plurality of product from a stream of product to any of a plurality of input devices and feeding the product to output bins based on a code associated with each product. Each of the input devices is assigned to a specific output group of the plurality of output groups for a second pass phase. In the second pass phase, the input devices feed non-rejected product to the output bins of the specific output group assigned to the each input device which is feeding the non-rejected product. Additionally, the input devices feed, in the second sort phase, rejected product to an output bin common and accessible to any of the input devices.

In another aspect of the invention, a system includes means for providing a plurality of product from a stream of product and means for feeding each product to output bins based on a code in a first pass phase and second pass phase. A means is provided for assigning each feeding means to a specific output group for the second pass phase. A means is provided for constraining, in the second pass phase, non-rejected product of the plurality of product to the output bins of the specific output group assigned to the each feeding means which is feeding the non-rejected product. Additionally a means is provided for permitting, in the second pass phase, rejected product of the plurality of product to an output bin common and accessible to any of the feeding means.

DETAILED DESCRIPTION OF EMBODIMENTS OF THE INVENTION

The invention is directed to a sequencing system and method for increasing machine capacity and throughput. In an aspect of the invention, the sequencing system and method increases machine capacity and throughput of mail pieces such as packages, flats, mixed mail and the like (generally referred hereinafter as product). The system and method also significantly reduces processing times for sequencing the products in delivery point sequence using, in an embodiment, parallel processing. Other applications such as warehousing and storage applications are also contemplated for use with the invention.

Sequencing System of the Invention

Figure 1:
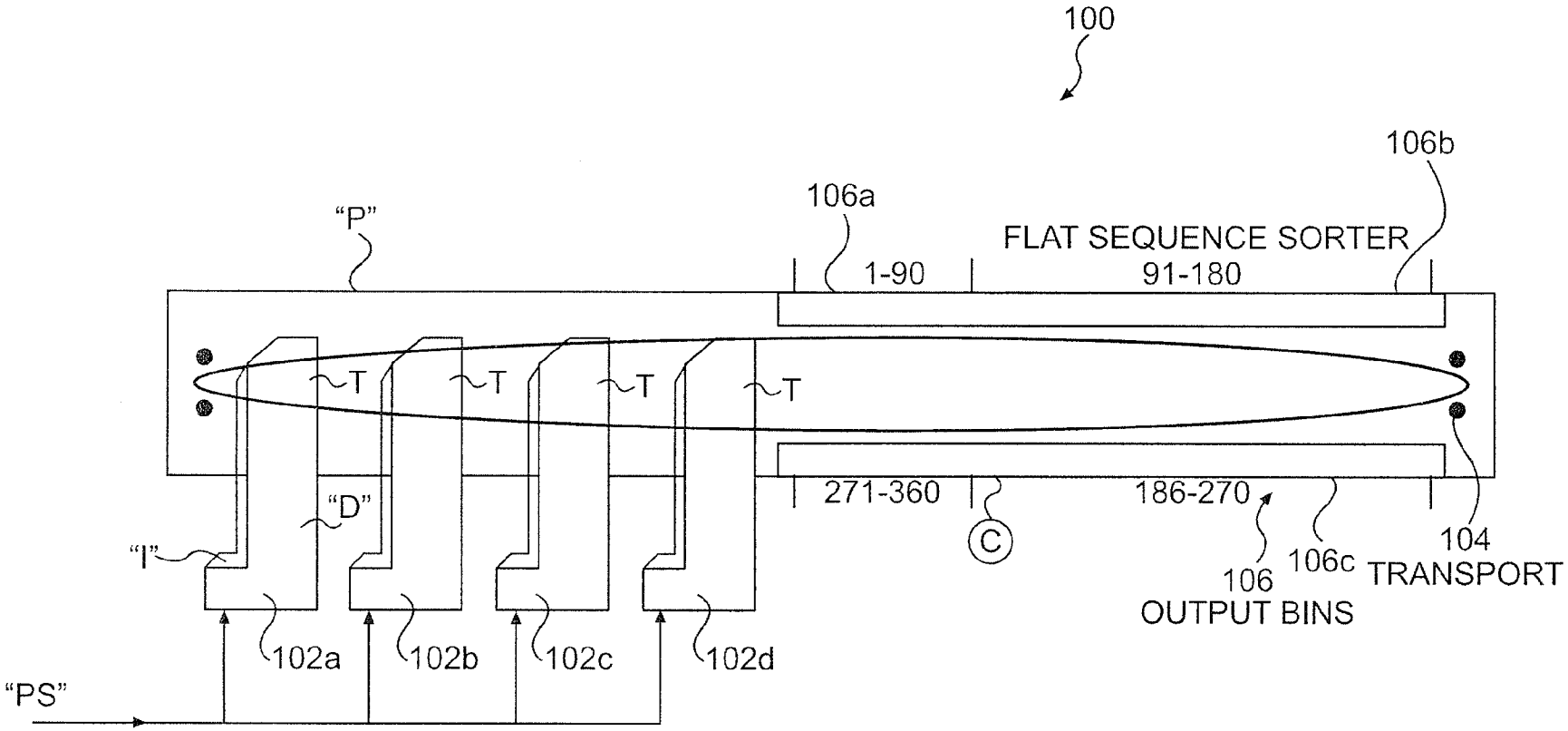
FIG. 1 shows one aspect of a sequencing system of the invention.

Referring now to FIG. 1, a general schematic diagram of a sequencing system is shown. In the embodiment of FIG. 1, the sequencing system is generally depicted as reference numeral 100 and includes a plurality of induction points or input feeding devices 102*a*, 102*b*, 102*c* and 102*d*. In the embodiment of FIG. 1, four input feeding devices are shown for illustration; however, the sequencing system may use any number of input feeding devices such as two, three or more input feeding devices depending on the particular application. In one embodiment, the input feeding devices each have a feed rate capacity of approximately 10,000 letters per hour, and may include a pause device "P" as well as an inserter "I" and an optical reader "O" such as an optical recognition reader (OCR), all communicating and controlled by a controller "C". Those of ordinary skill in the art should recognize that other feeding capacity rates may also be used with the invention, and that the input feeding devices illustrated herein are provided for showing an exemplary description of the invention.

Referring still to FIG. 1, a conventional type transporting system 104 is provided for transporting the products between the input feeding devices and output bins 106. In one aspect of the invention, the products, of product stream "PS", are inducted into any of the input feeding devices via the inserters "I" in any random order. The OCR will read a code associated with each of the products such as an address code or the like, and thereafter the product will be transported to a respective output bin 106 via the transporting system 104 under the control of controller "C".

In an embodiment, a grouping of contiguous output bins 106 may be designated for any number of respective carrier routes or groupings of product. In one example, four output groups 106*a*, 106*b*, 106*c* and 106*d* of output bins are each associated With respectively assigned input feeding devices 102*a*, 102*b*, 102*c* and 102*d*. In this particular embodiment, 90 output bins are associated with each output group for a total of 360 output bins. Although 90 output bins are illustrated herein, any number of output bins may be associated with each output group. Also, the output groups may correspond in number to the input feeding devices implemented by the invention.

Figure 2:
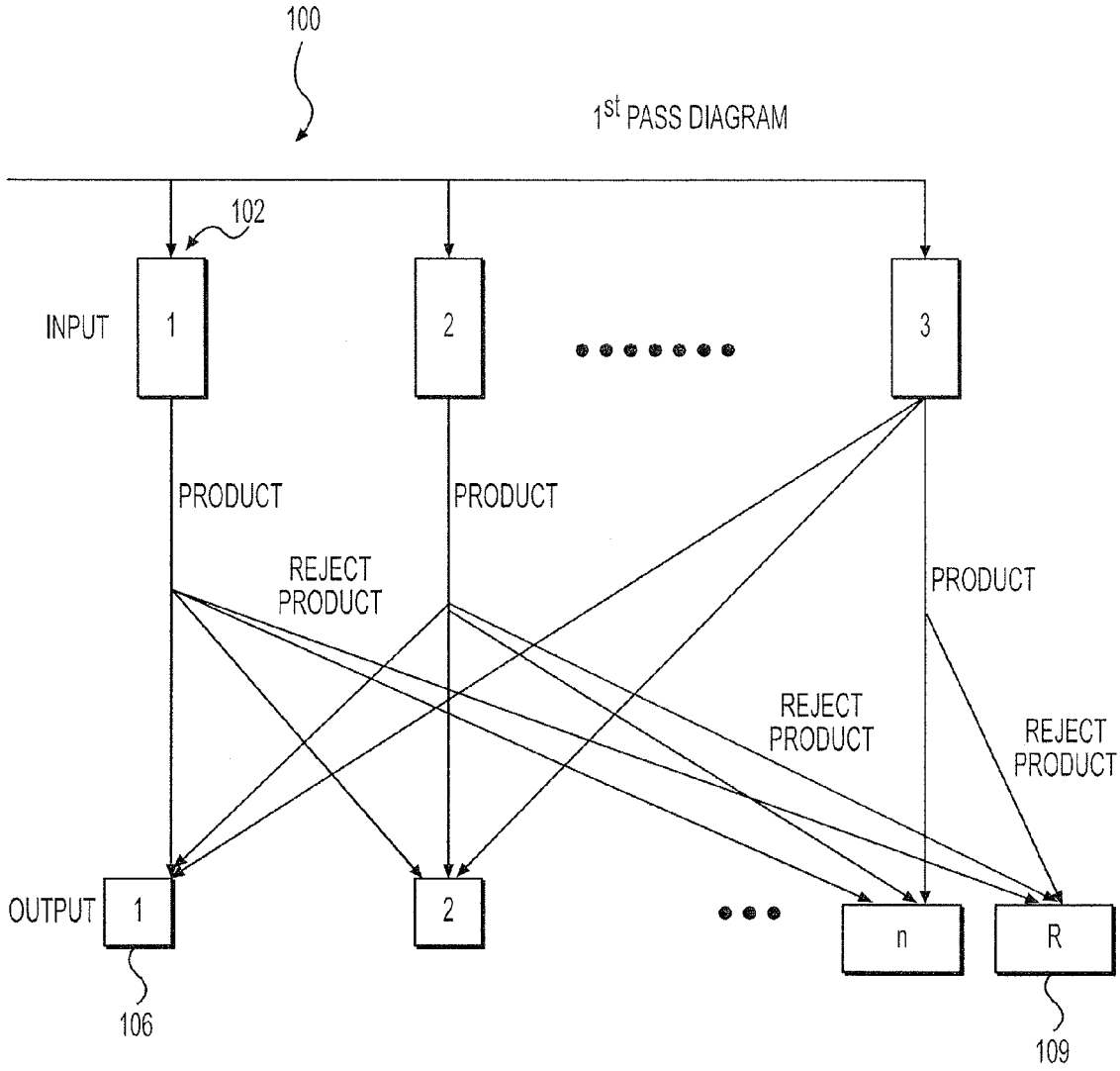
FIG. 2 shows a general schematic view of a first phase of sorting products using the sequencing system of the invention.

FIG. 2 shows a general schematic view of a first phase of sorting using the sequencing system 100. In the first pass phase, the product for any, number of routes such as 1 through n routes is presented to the input feeding devices in any order to any input feeding device. The products are then fed through the input feeding devices and deposited into an output bin associated with one of the output groups based on a sort key or code, which is read by the OCR (discussed in greater detail below). That is, each input feeding device will read and process a portion of the sort key, via the OCR and controller "C", respectively, to direct the product to a particular output bin. In the first pass phase, all input feeding devices 1, 2, . . . n have complete access to all output bins of all the output groups 1, 2, . . . n such that no segregation of the route is required. Rejected product from a first pass may be directed to a reject bin 109.

In the illustrative example of FIG. 2, after a first pass phase, the product may be segregated into groups of 10 routes each, where:

(i) product from routes 1-10 are in group 1, (ii) product from routes 11-20 are in group 2, and (iii) product from routes N are in group n.

Those of ordinary skill will recognize that this is only one example which may be implemented by the system and method of the invention.

Figure 3:
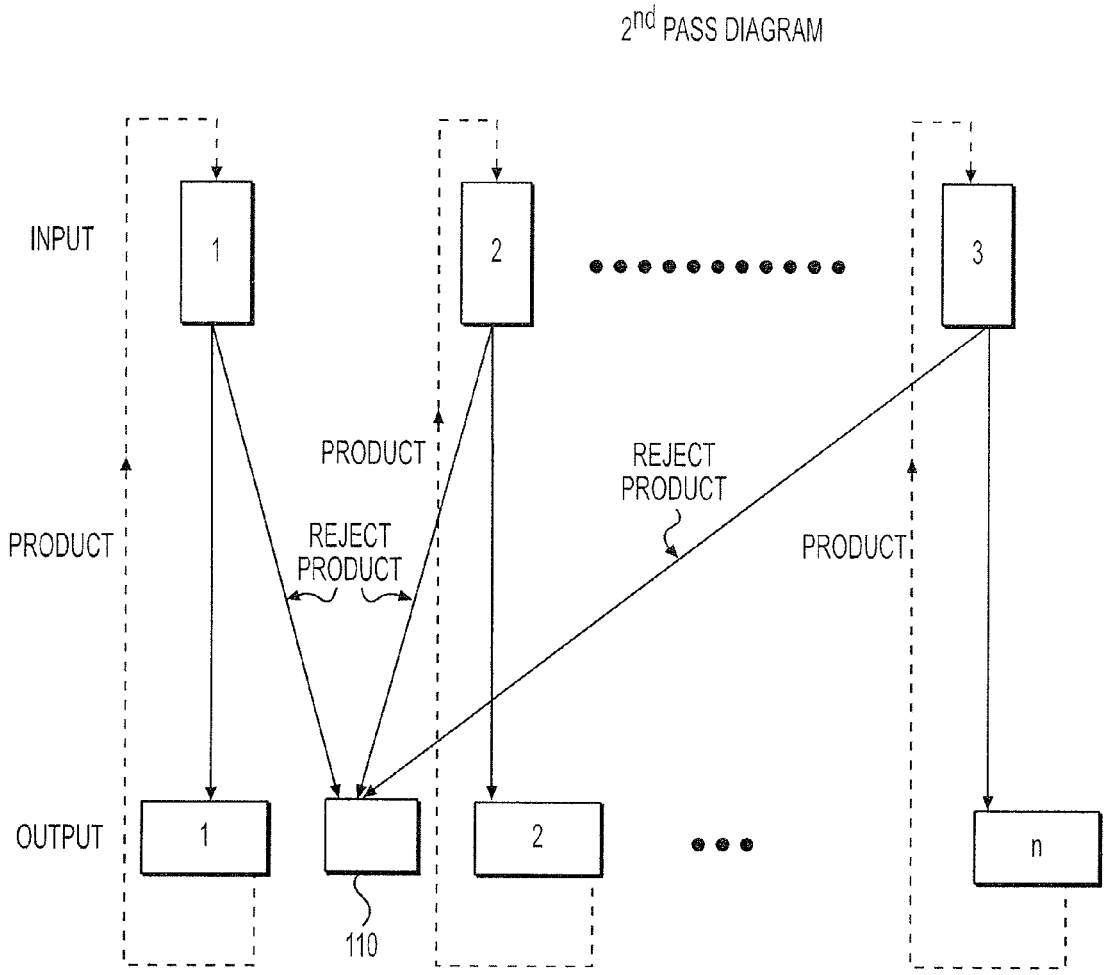
FIG. 3 shows a general schematic view of a second phase of sorting products using the sequencing system of the invention.

FIG. 3 shows a general schematic view of a second phase of sorting using the sequencing system 100. Each input feeding device is assigned a particular output group (e.g., four groups). In addition, in one embodiment, each of the input feeding devices may have access to one common "reject" bin 110 in one of the output groups. The bin 110 may be one or more bins and may be in a separate output group. This allows all of the rejected product supplied from any of the input feeding devices to be directed to a common bin, while the remaining product are supplied to the respective output bins in respective output groups for sequencing. This sorting scheme results in a greater system capacity.

Now referring more specifically to FIG. 3, in a second pass phase, the product of the first output group will be fed through the first input feeding device to the output bins of the first output group, the product of the second output group will be fed through the second input feeding device to the output bins of the second output group, the product of the n output group will be fed through the n input feeding device to the output bins of the n output group, etc, all having a code read by a respective OCR of the input feeding devices. In this manner, the non-rejected products are delivered to a respective output group, now in sequence. In one embodiment, the system may be placed under a constraint, to a certain extent, to maintain the output groups between the first and second pass phase.

In one embodiment, the input feeding devices are not constrained, in the second pass phase, to output bins of a single respective output group. By way of example, rejected products from each of the input feeding devices are fed to a common output bin 110. The common output bin may be a single or multiple output bins, and may be in a separate output group. The product may be rejected based on, for example, misreading or non-reading of the sort key, operator error (i.e., improper feeding of the mail pieces into the input feeding devices), machine mistiming (i.e., a mail tub not being placed in a timely manner in an output bin), etc.

As shown in FIG. 3, to accomplish an increased throughput and capacity of the system all of the input feeding devices have complete access to the common output bin(s) in one of the segregated output groups. This increases the capacity of the sequencing system by allowing more output bins in each of the n output groups to be allocated to the sequencing of the non-rejected product during the second pass phase. For example, sorting machines have a processing capacity based on the square of the total number of output bins. Thus, in a sequencing system with 90 output bins per group, a total of $90^2$ or 8100 delivery points can be processed for each output group. If there is one reject bin for each of four output groups, then only 89 bins are available for processing or sequencing the product for each group, reducing the total of processing points to 89 $\text{bins}^2 \times 4$ output groups or 31,684 processing points. In comparison, if a "reject" bin is provided in only one output group, but available to all input feeding devices, then 32,221 processing points are available for sequencing the product (i.e., (89 $\text{bins}^2 \times 1$ output group)+(90 $\text{bins}^2 \times 3$ output groups)), resulting in 537 more processing points or the equivalent of approximately one route.

When the second pass phase is complete, the product in each grouping of n output groups will have its product in sequential order. The sequenced product will be passed out of the machine through a conveyor system that maintains the sequence of the product. The rejected product in the common output bin 110 may be manually processed in sequence order.

Method of Sequencing Product using the System of the Invention

The system of the invention may be used for a single carrier route at a time, multiple routes at once or for warehousing or other sequencing needs of products. In one implementation, the sequencing method uses a two-pass sort scheme to sequence the product using multiple input feeding devices in both the first pass phase and the second pass phase. In the second pass phase, all of the rejected product from each of the input feeding devices may be fed to a single common output bin to increase the capacity of the system. The remaining "non-rejected" product may be fed to output bins in a single output group associated with a particular input feeding device. The rejected product may be manually sorted.

The sequencing system uses, in one embodiment, a disjoint sort key but other types of sort keys are also contemplated for use by the sequencing system of the invention. In one implementation, the scheme for sequencing the product may include:

1. Providing a sort code or sequence number for each product based on the address or other product information of the product.

2. Determining whether the product is going through a first pass or a second pass phase.

3. If the product is going through a first pass phase, the sequencing system will read a first portion of the sort key and assign the product to an appropriate output bin in one of the n output groups.

4. If the product is going through a second pass phase, the sequencing system will read a second, different portion of the sort key and assign the product to an appropriate output in the respective output group, now in a delivery point sequence.

5. The sequencing system is iterative and will continue both the first and the second pass phase in the manner described above until all of the products have passed through the system and the appropriate products have been provided in sequence after the second pass phase.

The use of the sorting scheme provided above is an illustrative example and, as such, it should be understood that the use of different codes or sort keys may equally be implemented by the invention without varying from the scope thereof.

Figure 4:
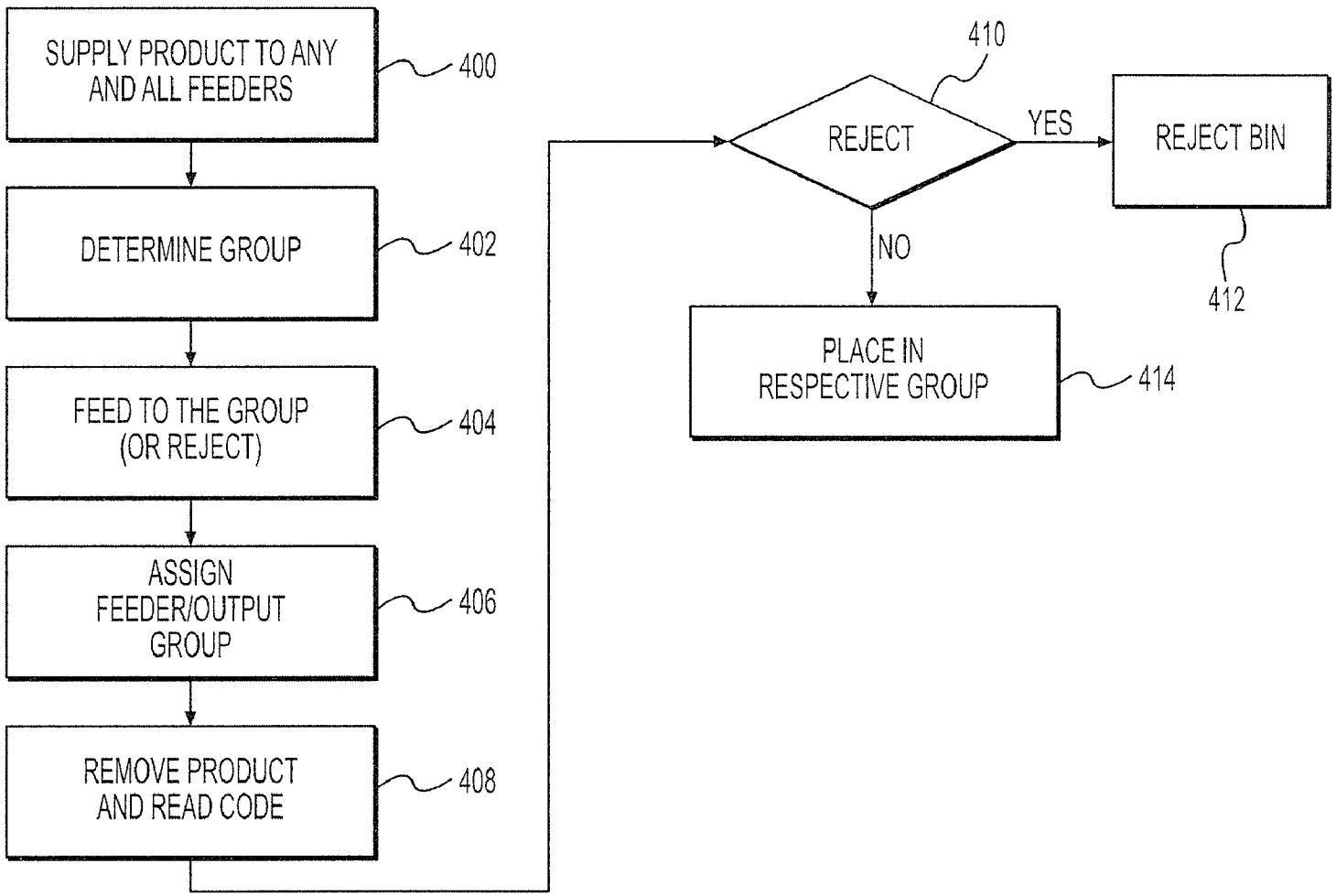
FIG. 4 is a flow diagram showing the steps implementing the invention.

FIG. 4 is a flow diagram implementing the steps of the invention. The controller "C" may be used to implement such steps of the invention as shown in FIG. 4 in a first and second mode of operation (first and second pass phase). In the first pass phase, all the product is presented, in a product stream, to any and all of the input feeding devices in any random order (step 400). In step 402, a determination is made as to which product will be fed to which output bin from each of the input feeding devices. In step 404, the product is fed and deposited to the specific output bin based on the sort key or associated code. That is, the OCR will read the sort key or associated code and the controller "C" will direct the product to a particular output bin of a particular output group or, in an embodiment, reject the product, via the transporting system. All input feeding device have complete access to all output bins of each of the output groups in this phase such that no segregation is required. Additionally, the assigned groupings may be maintained for the following second pass phase.

In step 406, each input feeding device is assigned to a particular output group (e.g., four groups). In one embodiment, each of the input feeding devices may, in addition, have access to the "reject" bin in one of the output groups. This allows rejected products supplied from any of the input feeding devices to be directed to a common output bin, while the remaining products are provided to the respective output groups for sequencing. In step 408, the products are removed from the output groups and read by the OCR of a respectively assigned input feeding device, i.e., product of group 1 will be fed through input feeding device 1. The products should, in an embodiment, remain in order of the bin count, i.e., 1-90 for each output group, when being fed through the respective input feeding device for the second pass phase.

During the second pass phase, each OCR of the respective input feeding device reads the sort key of a particular product (step 408). In the second pass phase:

(i) the product being inducted into each input feeding device is identifiable as to order and group; and (ii) the rejected products, in one embodiment, are directed to a common output bin of one of the segregated output groups, while the remaining product supplied from the remaining input feeding devices are directed to a respective output group for that associated input feeding device.

In step 410, a determination is made as to whether there is a rejected product. If there is a rejected product, then in step 412, the product is directed to an output bin in one of the output groups. All of the input feeding devices have access to and the capability of feeding the rejected product to the common output bin in one of the output groups. So, during the second pass phase, the rejected product supplied from any of the input feeding devices may be constrained (i.e., assigned and directed) to a common output bin in one of the output groups. In this manner, rejected products, regardless of initial grouping assignment, can be assigned and directed to a same output group accessible to each of the input feeding devices. In this embodiment, multiple input feeding devices may have complete access to a respective output group in addition to the output group with the "reject" output bin.

If the product is not rejected, a constraint of the sequencing system now forces the product to its respective output group and only to those outputs, in step 414. In other words, input feeding device 1 feeds product to output group 1 and the output bins in that group. This is repeated for the other groups, as well. This implementation provides a significant total realized throughput increase.

While the invention has been described in terms of embodiments, those skilled in the art will recognize that the invention can be practiced with modification within the spirit and scope of the appended claims.

It is claimed:

1. A system for sequencing products, comprising:

a plurality of input feeding devices each randomly receiving product from a stream of product;

a plurality of output groups each having a plurality of output bins; and a control system having a mode which constrains the input feeding devices to (i) feeding non-rejected product to output bins of assigned output groups of the plurality of output groups associated with a corresponding one of the plurality of input feeding devices, and (ii) feeding rejected product to at least one output bin of the plurality of output bins in a single group accessible to any of the plurality of input feeders.

2. The system of claim 1, wherein each of the plurality of input feeding devices directs the rejected product from the stream of product to the at least one output bin in the single group based on at least one of misreading or non-reading of a code associated with the rejected product and an operator or machine error.

3. The system of claim 1, wherein a number of the plurality of input feeding devices equals a number of the plurality of output groups.

4. The system of claim 1 wherein the at least one output bin is a single reject output bin.

5. The system of claim 4, wherein the single reject output bin increases a capacity of processing points for sequencing the product during a second pass phase in the plurality of output groups.

6. The system of claim 4, wherein the single reject output bin is provided in a separate output group from the assigned output groups.

7. The system of claim 1, wherein the control system assigns each input feeding device to a respective one of the assigned output groups of the plurality of output group for feeding the non-rejected product during a second pass phase.

8. The system of claim 7, wherein the control system constrains each input feeding device to the at least one output bin for feeding the rejected product during the second pass phase.

9. The system of claim 1, wherein the control system assigns each of the assigned output groups to a designated number of routes.

10. The system of claim 1, wherein the plurality of input feeding devices is two input feeding devices.

11. The system of claim 1, wherein the plurality of input feeding devices is four input feeding devices and the plurality of output groups is equal to a number of the plurality of input feeding devices.

12. The system of claim 1, wherein the control system provides the plurality of input feeding devices access to all of the plurality of output groups during a first pass phase of sorting the products.

13. The system of claim 1, wherein the plurality of input feeding devices is equal to a number of the plurality of output groups.

14. The system of claim 1, wherein the product is mail pieces.

15. A method of sequencing product, comprising the steps of:

providing a plurality of product from a stream of product to any of a plurality of input devices;

feeding, in a first pass phase, each product of the plurality of product to output bins based on a code associated with each product of the plurality of product;

assigning each input device of the plurality of input devices to a specific output group of the plurality of output groups for a second pass phase;

feeding, in the second pass phase, non-rejected product of the plurality of product to the output bins of the specific output group assigned to the each input device which is feeding the non-rejected product; and feeding, in the second pass phase, rejected product of the plurality of product to an output bin common and accessible to any of the input devices.

16. The method of claim 15, wherein the rejected product is based on one of a misreading or non-reading of a code associated with the rejected product and an operator error.

17. The method of claim 15, wherein the rejected products are fed by each input device of the plurality of input devices to the commonly accessible output bin.

18. The method of claim 15, further comprising the step of determining whether the product is going through a first pass phase or a second pass phase and adjusting a control system between a first mode of operation and a second mode of operation, respectively.

19. The method of claim 15, wherein the commonly accessible output bin is one of the output bins of the specific output group and the any of the input devices are all of the input devices.

20. The method of claim 15, wherein the product is mail pieces.

21. A system for sequencing product, comprising:

means for providing a plurality of product from a stream of product;

means for feeding each product of the plurality of product to output bins based on a code in a first pass phase and second pass phase;

means for assigning each feeding means to a specific output group of the plurality of output groups for the second pass phase;

means for constraining, in the second pass phase, non-rejected product of the plurality of product to the output bins of the specific output group assigned to the each feeding means which is feeding the non-rejected product; and means for permitting, in the second pass phase, rejected product of the plurality of product to an output bin common and accessible to any of the feeding means.

22. The system of claim 21, wherein at least the means for constraining and the means for permitting is a control system operable in a first mode of operation and a second mode of operation.

23. The system of claim 21, wherein the product is mail pieces.

* * * * *